US011313130B2

(12) United States Patent
Whytlaw

(10) Patent No.: US 11,313,130 B2
(45) Date of Patent: Apr. 26, 2022

(54) RETRACTABLE ROOF/WALL ASSEMBLY

(71) Applicant: Advanced Design Innovations Pty. Ltd., Wodonga (AU)

(72) Inventor: Michael Whytlaw, Wodonga (AU)

( * ) Notice: Subject to any disclaimer, the term of this patent is extended or adjusted under 35 U.S.C. 154(b) by 0 days.

(21) Appl. No.: 16/760,703

(22) PCT Filed: Oct. 30, 2018

(86) PCT No.: PCT/AU2018/000211
§ 371 (c)(1),
(2) Date: Apr. 30, 2020

(87) PCT Pub. No.: WO2019/084590
PCT Pub. Date: May 9, 2019

(65) Prior Publication Data

US 2020/0354962 A1 Nov. 12, 2020

(30) Foreign Application Priority Data

Oct. 30, 2017 (AU) ..... 2017904402

(51) Int. Cl.
*E04F 10/10* (2006.01)
*E06B 7/082* (2006.01)
*E06B 7/096* (2006.01)

(52) U.S. Cl.
CPC ..... *E04F 10/10* (2013.01); *E06B 7/082* (2013.01); *E06B 7/096* (2013.01)

(58) Field of Classification Search
CPC ..... E04F 10/10; E04B 7/163; E04B 7/166; E06B 7/086; E06B 7/084; E06B 7/096; E06B 7/082; E06B 9/368
See application file for complete search history.

(56) References Cited

U.S. PATENT DOCUMENTS 2,135,647 A * 11/1938 Streby ..... E06B 9/368 160/172 R
5,291,946 A * 3/1994 Ciriaci ..... E06B 9/362 160/177 R
6,076,588 A * 6/2000 Swiszcz ..... E06B 9/262 160/168.1 V (Continued)

FOREIGN PATENT DOCUMENTS

WO WO 2015/0112263 A1 1/2015

*Primary Examiner* — Justin B Rephann
(74) *Attorney, Agent, or Firm* — Edwin D. Schindler

(57) ABSTRACT

An architectural structure includes retractable and moveable louvres having a frame having a rear end, a front end and a pair of side walls connecting the front end and the rear end and a plurality of louvres extending substantially between the side walls, with at least one end of the louvres being mounted to a gearbox member for controlling the angular orientation of the louvre. Each gearbox member is mounted upon a track extending substantially along a length of at least one side wall and at least one of the gearbox members is mounted to a belt driven by a drive pulley to move one or more gearbox members along the track, in which each gearbox member is attached to an adjacent gearbox member by way of a connector, with the length of the connector extending between adjacent gearbox members being constant such that, when the louvres are in an extended position, the spacing between the louvers is maintained at a predetermined distance.

4 Claims, 12 Drawing Sheets

(56) References Cited

U.S. PATENT DOCUMENTS

| | | | | |
|---|---|---|---|---|
| 10,094,122 | B1 * | 10/2018 | Akbulut | E04F 10/10 |
| 10,280,625 | B2 * | 5/2019 | Byszenski | E04F 10/10 |
| 10,851,544 | B1 * | 12/2020 | Volin | E04F 10/10 |
| 10,934,770 | B2 * | 3/2021 | Badenhorst | E06B 9/0638 |
| 2013/0056159 | A1 * | 3/2013 | Gray | E04F 10/10 160/40 |
| 2014/0130988 | A1 * | 5/2014 | Frigerio | E04F 10/10 160/138 |
| 2015/0152682 | A1 | 6/2015 | Whytlaw | |
| 2015/0376901 | A1 * | 12/2015 | Partridge | E04B 1/82 52/1 |
| 2017/0138057 | A1 * | 5/2017 | Ventrella | E04F 10/10 |
| 2017/0226746 | A1 * | 8/2017 | Byszenski | E04B 7/166 |
| 2019/0145107 | A1 * | 5/2019 | Byszenski | E04B 7/163 160/62 |

* cited by examiner

RETRACTABLE ROOF/WALL ASSEMBLY

RELATED APPLICATIONS

The present application claims priority from Australian Provisional Patent Application No. 2017904402 filed 30 Oct. 2017, the entire content of which is incorporated herein by reference.

FIELD OF INVENTION

The present invention relates generally to architectural structures, such as roofs and walls, and in particular, to a retractable roof/wall structure comprising a plurality of louvres that are moveable and retractable to open/close and retract as desired.

BACKGROUND OF THE INVENTION

Modern architecture generally seeks to combine indoor and outdoor living in away that maximises the enjoyment of sunshine and light but which also provides a degree of privacy and protection from the elements. It is the ability to provide a degree of control over the amount by which outdoor elements can be permitted into an indoor space which provides the most successful combination of such spaces.

Many homes and offices seek to make use of outdoor spaces by building pergolas or decks which are generally exposed to the elements but which may incorporate retractable roofing or walls which can be employed to provide a degree of protection from the elements if desired. Similarly, such spaces often employ louvres or shutters to enable a degree of control over the amount of sunlight that may enter the structure to provide a desired degree of comfort for those enjoying the space, whilst maximising a view or exposure to sunlight.

Thus there have been proposed wall and roof structures which incorporate moveable louvres to control the amount of light that passes therethrough and which can be fully retracted to open a space as desired. However, many such proposals have incorporated a variety of complicated and intricate control mechanisms to collectively move the louvres and to control the angle of the louvres which are difficult to maintain and expensive to manufacture. Due to the intricate control required to collectively control the state of each louvre present in such a structure, it is common from many structures to fail to open/close correctly over time, resulting in the need for constant servicing and replacement of moving parts.

Thus, there is a need to provide a system for providing enhances control of such structures incorporating movable and retractable louvres and which is simple and effective to operate.

The above references to and descriptions of prior proposals or products are not intended to be, and are not to be construed as, statements or admissions of common general knowledge in the art. In particular, the above prior art discussion does not relate to what is commonly or well known by the person skilled in the art, but assists in the understanding of the inventive step of the present invention of which the identification of pertinent prior art proposals is but one part.

STATEMENT OF INVENTION

The invention according to one or more aspects is as defined in the independent claims. Some optional and/or preferred features of the invention are defined in the dependent claims.

According to a first aspect, the present invention provides an architectural structure comprising retractable and moveable louvres comprising:

a frame having a rear end, a front end and a pair of side walls connecting the front end and the rear end;

a plurality of louvres extending substantially between the side walls, at least one end of the louvres being mounted to a gearbox member for controlling the angular orientation of the louvre, each gearbox member is mounted upon a track extending substantially along a length of at least one side wall and at least one of the gearbox members is mounted to a belt driven by a drive pulley to move said at least one gearbox member along said track;

wherein, each gearbox member is attached to an adjacent gearbox member by way of a connector with a length of the connector extending between adjacent gearbox members being constant such that when the louvres are in an extended position, the spacing between the louvres is maintained at a predetermined distance.

In one embodiment, the connector is a belt and the pitch of the belt extending between adjacent gearboxes is controlled to maintain the spacing between louvres when in the extended position at a predetermined distance.

Each gearbox member may be mounted to the track so as to facilitate longitudinal movement of the gearbox along said track and rotational movement of the gearbox about the longitudinal axis of the track. The track may be substantially circular in cross-section and each gearbox may be mounted to the track by way of at least two opposing V-wheels which engage with the track. In one preferred form, each gearbox may be mounted to the track by way of three V-wheels, two of the V-wheels being laterally disposed to engage with an upper surface of the track and one V-wheel engaging with a lower surface of the track.

Each of the louvres may be mounted at one common end to an operational gearbox that is controllable to vary the angular orientation of the louvre and at the other end to an idler gearbox that supports the louvre and facilitates angular movement of the louvre under action of the operational gearbox.

Reference throughout this specification to 'one embodiment' or 'an embodiment' means that a particular feature, structure or characteristic described in connection with the embodiment is included in at least one embodiment of the present invention. Thus, the appearance of the phrases 'in one embodiment' or 'in an embodiment' in various places throughout this specification are not necessarily all referring to the same embodiment. Furthermore, the particular features, structures, or characteristic described herein may be combined in any suitable manner in one or more combinations.

BRIEF DESCRIPTION OF THE DRAWINGS

The invention may be better understood from the following non-limiting description of preferred embodiments, in which.

DETAILED DESCRIPTION OF THE DRAWINGS

Preferred features of the present invention will now be described with particular reference to the accompanying drawings. However, it is to be understood that the features illustrated in and described with reference to the drawings are not to be construed as limiting on the scope of the invention.

The present invention will be described below in relation to its application to wall or roof structure. However, it will be appreciated that the present invention could be equally applied to a variety of different structures and purposes where there is a need to control the angle of individual louvres with respect to each other and the location of the individual louvres with respect to each other, as will be appreciated by those skilled in the art.

Figure 1:
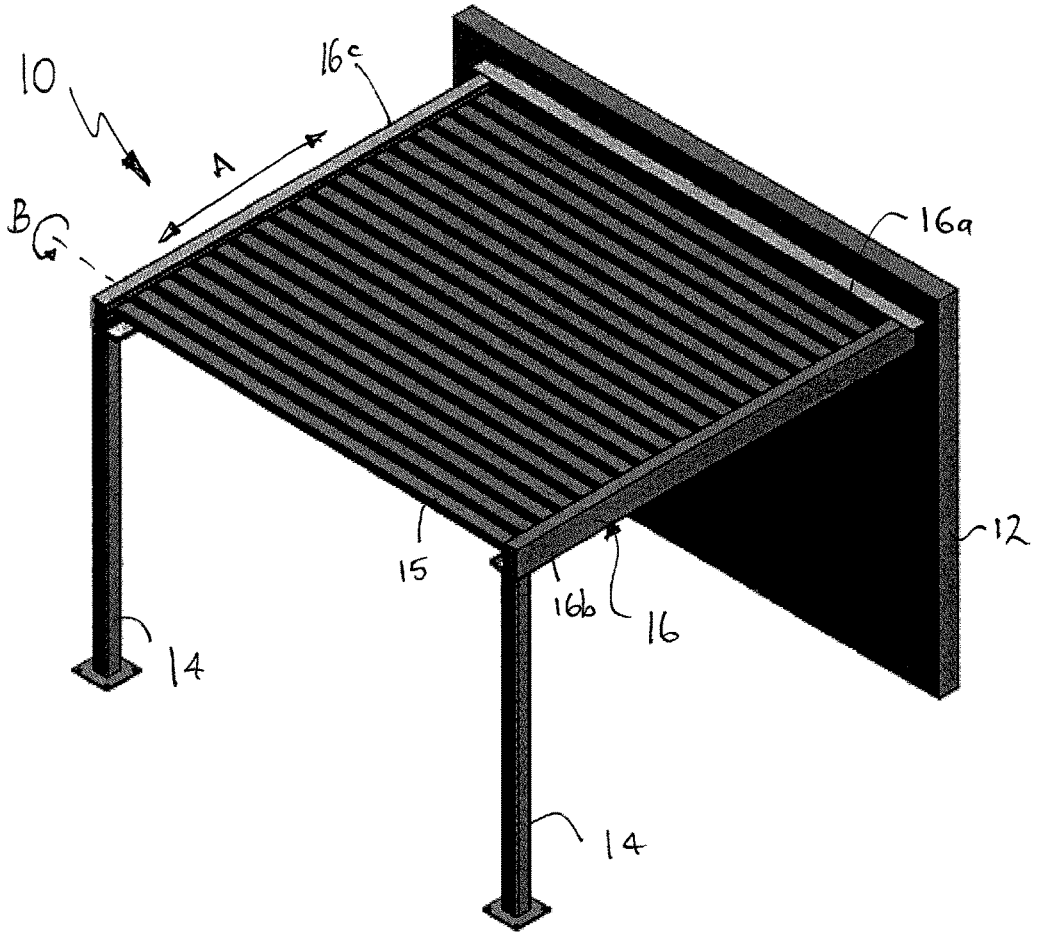
FIG. 1 is an embodiment of a roofing structure in accordance with the present invention.
Figure 2:
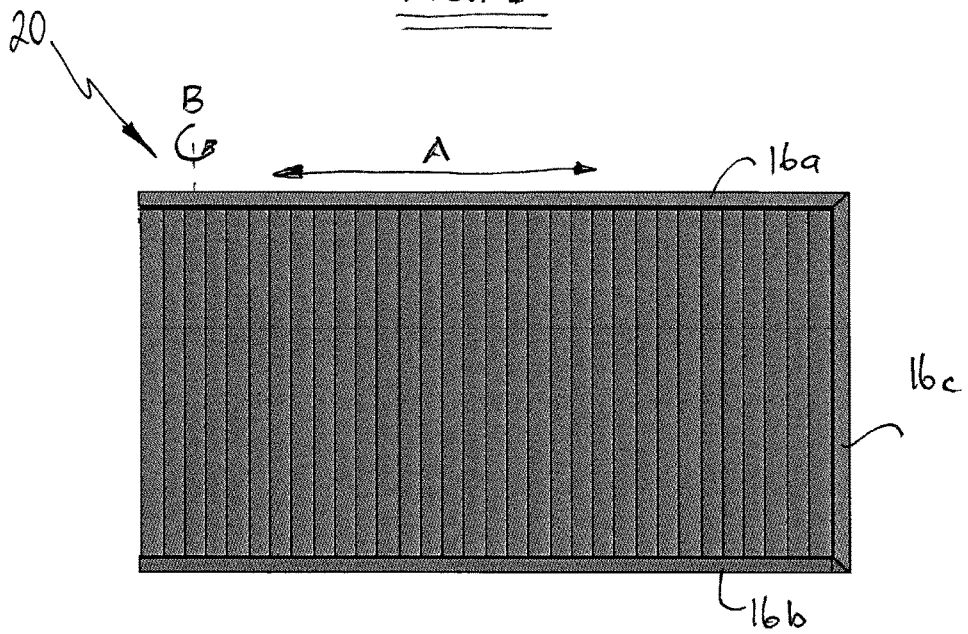
FIG. 2 is a wall structure in accordance with an embodiment of the present invention.

Turning to FIGS. 1 and 2, a roofing structure 10 and a wall structure 20 in accordance with an embodiment of the present invention is depicted.

The roofing structure 10 comprises a rear support 12, in the form of a wall or the like and a pair of front supports 14, in the form of piers or pylons. A frame 16 is mounted to the rear support 12 along a rear end 16*a* thereof and has a pair of sides 16*b*, 16*c* extending orthogonally from opposing ends of the rear end 16*a* to be supported at their distal ends by the front supports 14. In the embodiment as depicted, the frame 16 has an open front end 16*d*. However, it will be appreciated that the front end 16*d* may be closed by way of a front panel (not shown) that extends between the front supports 14.

A plurality of louvres 15 are mounted within the frame 16 so as to be substantially parallel with the rear end 16*a*. As will be discussed in more detail below, each of the louvres 15 may be arranged between a retracted position and an extended position as shown in FIG. 1 by movement in the direction of arrow 'A'. Each of the individual louvres 15 may also be rotationally controlled about their central axis 'B' such that the angular position of the louvres may be altered to enable light to pass through the roofing structure 10. The angle of inclination of each louvre may vary depending upon the requirements of the user, with FIG. 1 depicting the louvres 15 in a closed configuration whereby they extend laterally to form a closed roofing structure. It will be appreciated that whilst the embodiment of FIG. 1 is mounted to a support wall, the frame 16 may be mounted on each of its ends by way of 4 columns or supports and does not need a rigid wall support.

The wall structure 20 if FIG. 2 is similarly configured to the roofing structure 10 of FIG. 1 and similar reference numerals are used to represent similar features. In this regard, the wall structure 20 comprises a main frame 16 having an upper rail 16*a*, a lower rail 16*b*, and an end support 16*c*. The individual louvres 15 are arranged to extend between the upper rail 16*a* and the lower rail 16*b*, and an end support (not shown) may be provided to support the end of the upper rail 16*a*. The louvres 15 may be moved between a retracted position and an extended position (as shown) in the direction of arrow 'A'. Similarly, each louvre 15 is arranged to be rotational movable about its central axis 'B' so as to control the amount of light that may pass therethrough.

Figure 3:
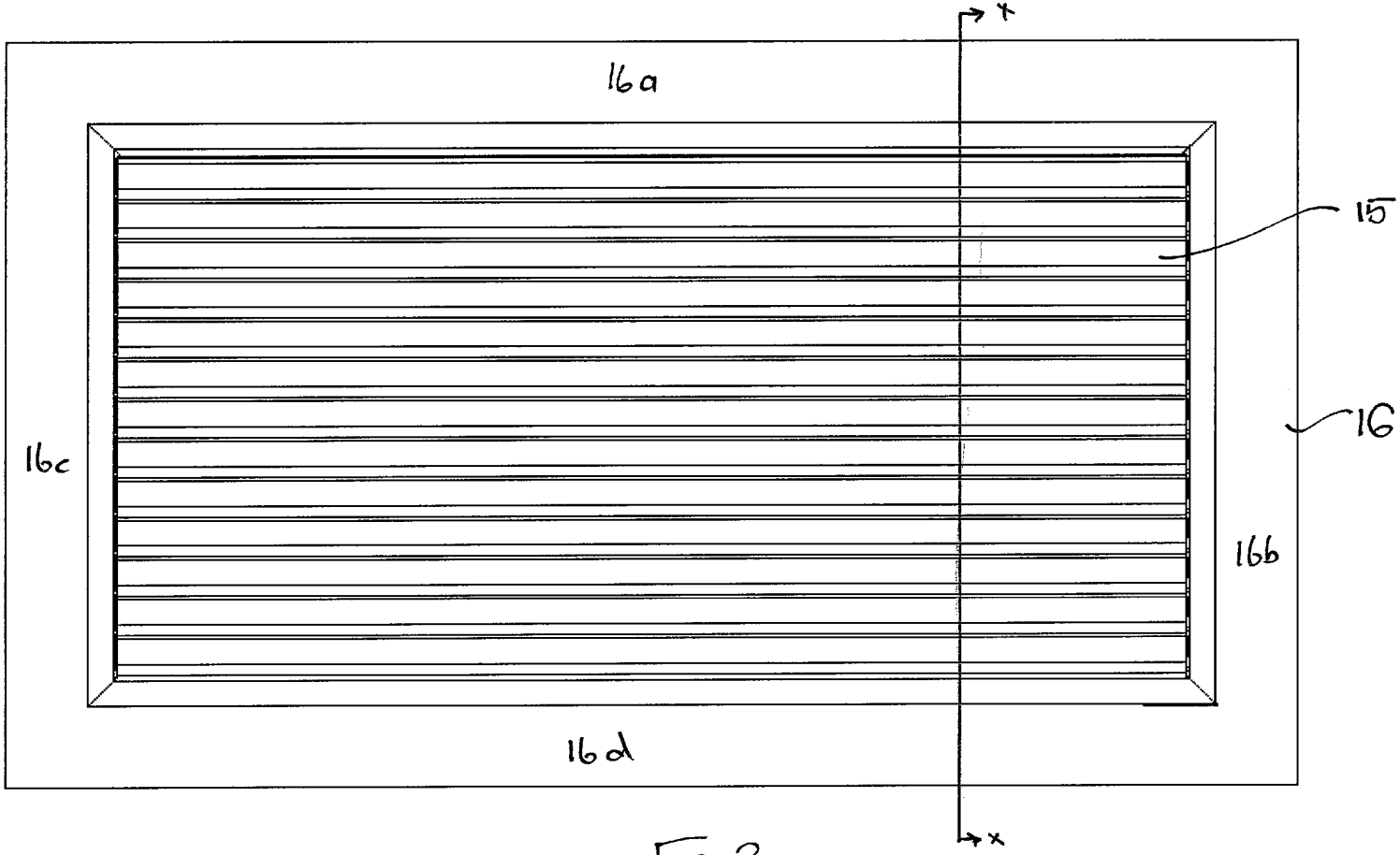
FIG. 3 is a top view of a roof structure with the louvres extended to close the recess therein.

Referring to FIG. 3 a roofing structure 10 is depicted employing the louver system of the present invention. In this embodiment, the frame 16 of the roofing structure has a rear end 16*a*, a front end 16*d* and a pair of sides 16*b* and 16*c*. The frame 16 defines an inner recess across which the louvres 15 extend.

Figure 4:
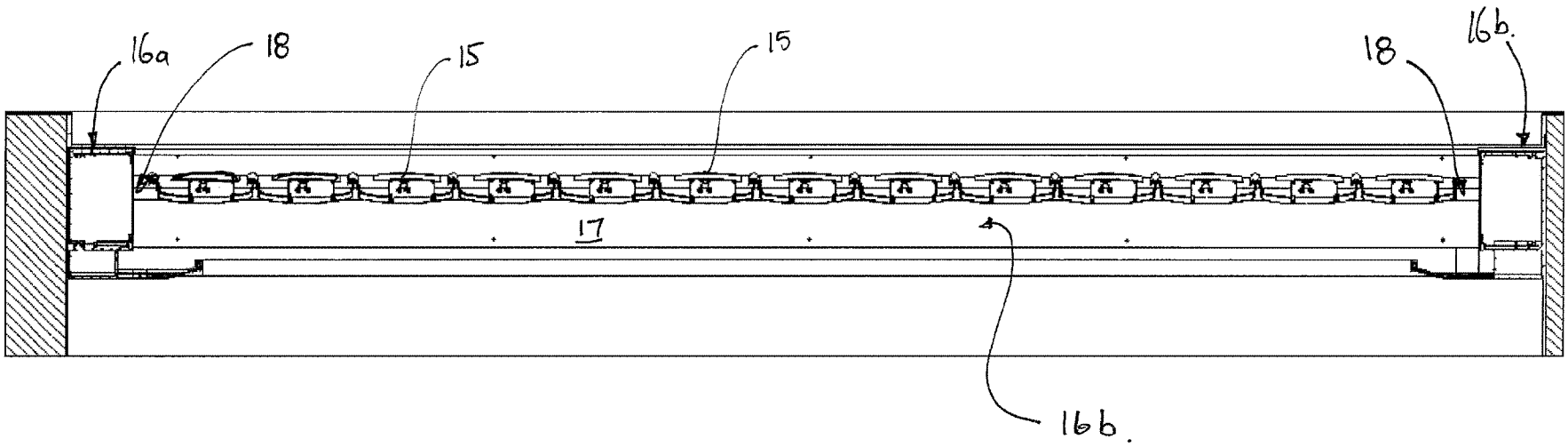
FIG. 4 is a cross sectional view of the roof structure of FIG. 3 along line x-x.

FIG. 4 is a cross sectional end view of the roofing structure 10, through line x-x of FIG. 3. As is shown, each of the louvres 15 extend from the rear end 16*b* to the front end 16*a* in a substantially parallel manner. In the embodiment as shown, the louvres 15 are in a closed configuration whereby they extend lengthwise across the recess in the roof to close the recess. Each of the sides, 16*b* and 16*c* are configured to comprise a substantially enclosed box 17 having a central slot 18 formed therein. The slot 18 enables the end of each louvre to be mounted to a mounting attachment provided on a gearbox housed within the box 17. As will be described in more detail below, each louvre 15 is mounted at each end to a gearbox that controls the angular position of the louvre 15, and each of the gearboxes are mounted within a retraction system located in the box 17 at each side 16*b*, 16*c*, which enables control of the position of the gearboxes and louvres 15, between an extended position and a retracted position.

Figure 5A:
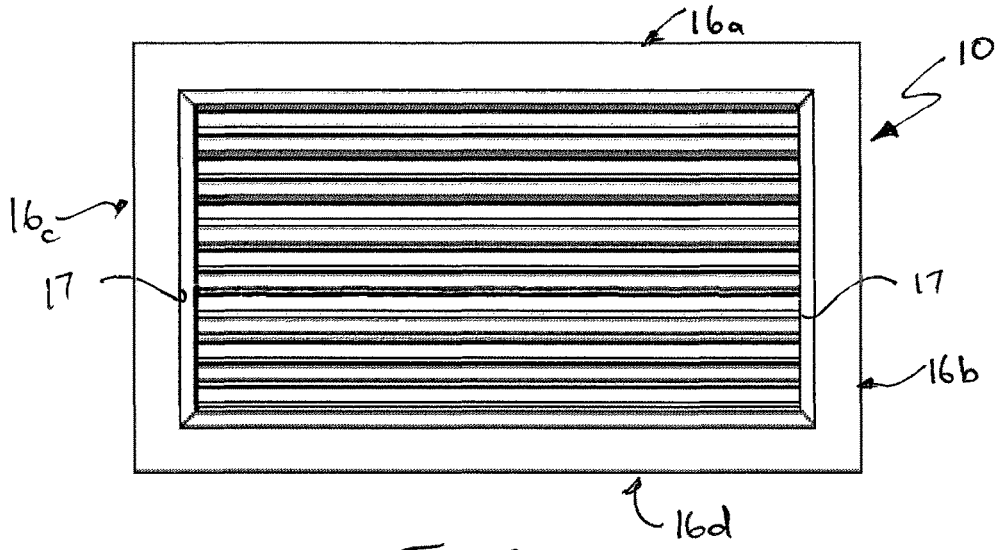
FIG. 5A-5C are top, cross-sectional and perspective views of a portion of the roof structure of FIG. 4 with the louvres in an extended and closed position.
Figure 5B:
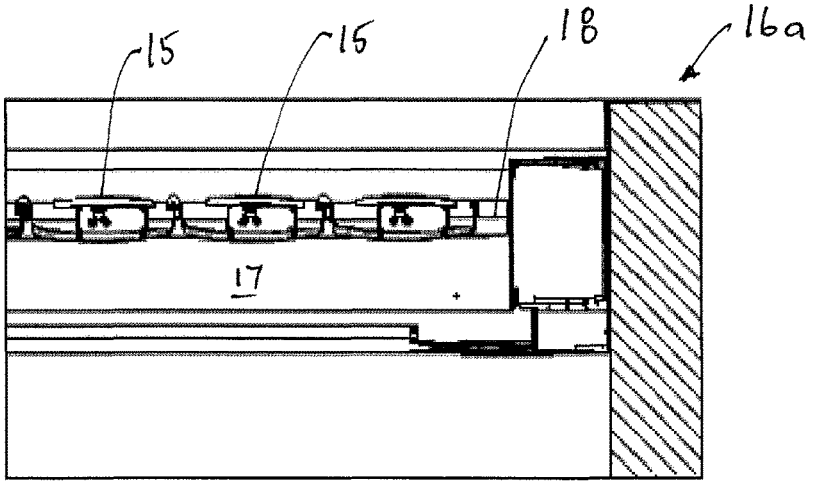
Figure 5C:
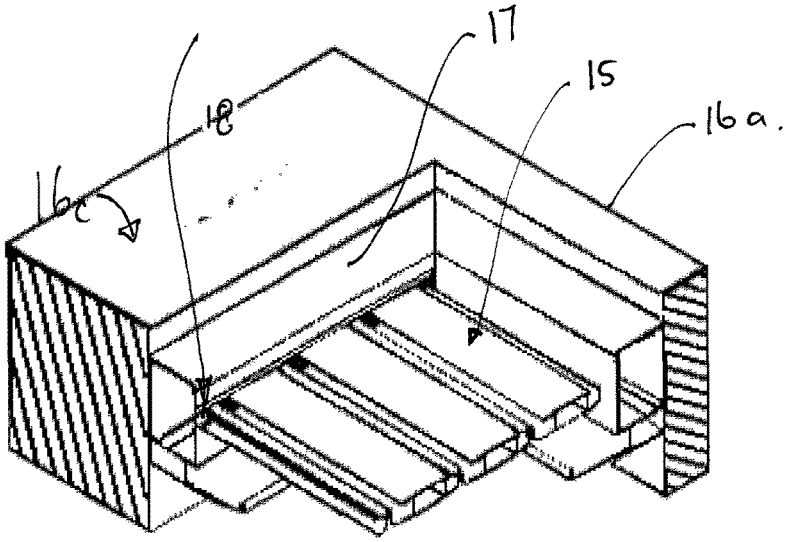

In this regard, FIGS. 5A-5C show the roofing structure 10 in the extended position, as depicted in FIGS. 3 and 4. In this position the retraction system is mounted within the boxes 17 functions to fully extend the louvres 15 such that the span the length of the recess in the roof. The gearboxes provided for each louvre are then controlled to maintain the louvres 15 in the horizontal position thereby extending across the recess in the roof to prevent light, rain, and the like from passing therethrough.

Figure 6A:
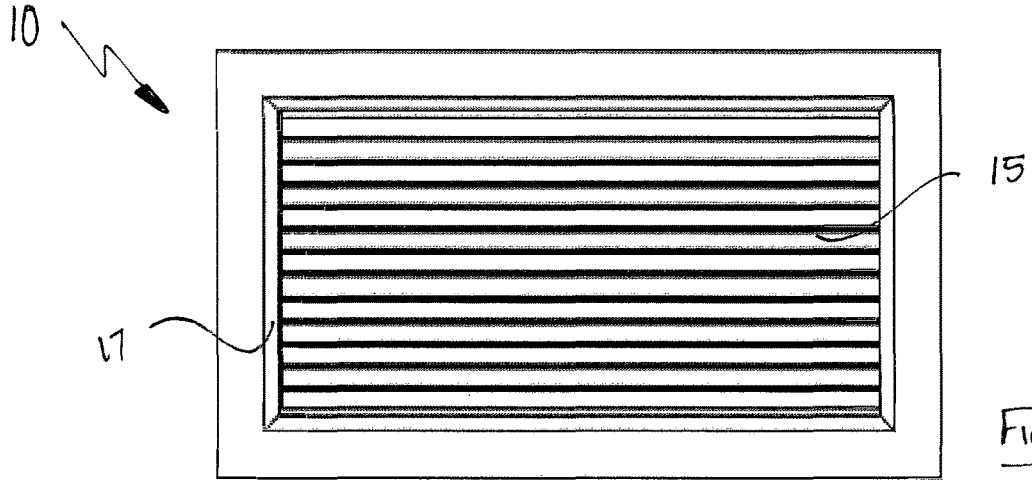
FIG. 6A-6C are top, cross-sectional and perspective views of a portion of the roof structure of FIG. 4 with the louvres in an extended and partially open position.
Figure 6B:
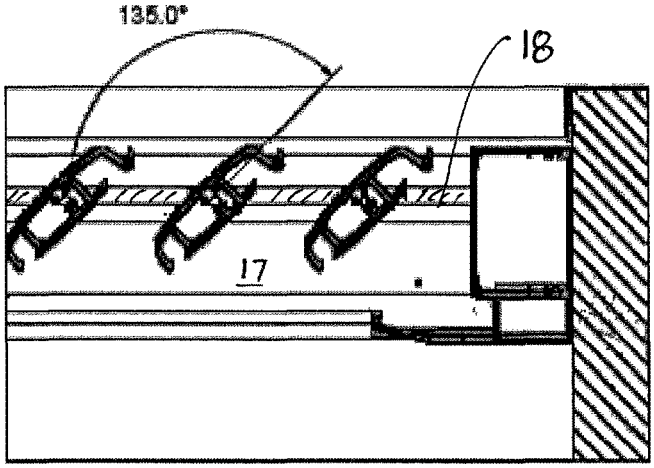
Figure 6C:
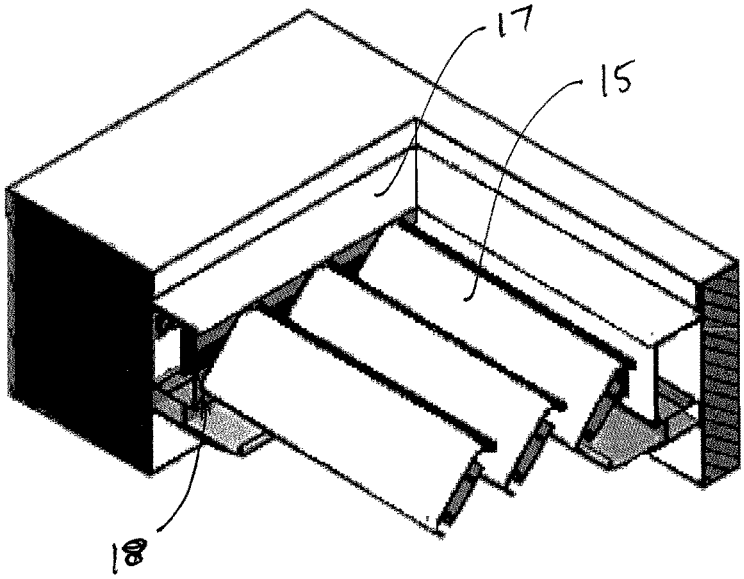

FIGS. 6A-6C depict the roofing structure 10 in another state whereby the louvres 15 are extended to span the recess in the roof, but are rotated to extend at an angle to the horizontal, namely at a 135° angle for the embodiment as depicted. This state enables filtered light to pass through the roofing structure 10 to provide air flow and a degree of shade into the underlying space. The angular movement of each louvre is provided by controlling the gearboxes housed within the boxes 17 located at each side 16*b*, 16*c* of the structure and which are provided at each end of each louvre 15. As the louvres 15 are mounted to a mounting arm of each gearbox that extends out each slot 18, each louvre 15 is able to be rotated from each end thereof, sharing the load between each end.

Figure 7A:
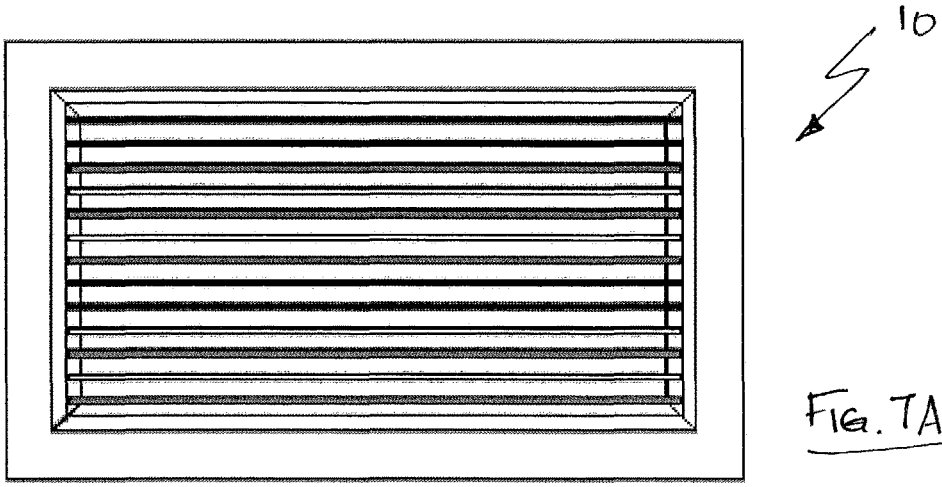
FIG. 7A-7C are top, cross-sectional and perspective views of a portion of the roof structure of FIG. 4 with the louvres in an extended and open position.
Figure 7B:
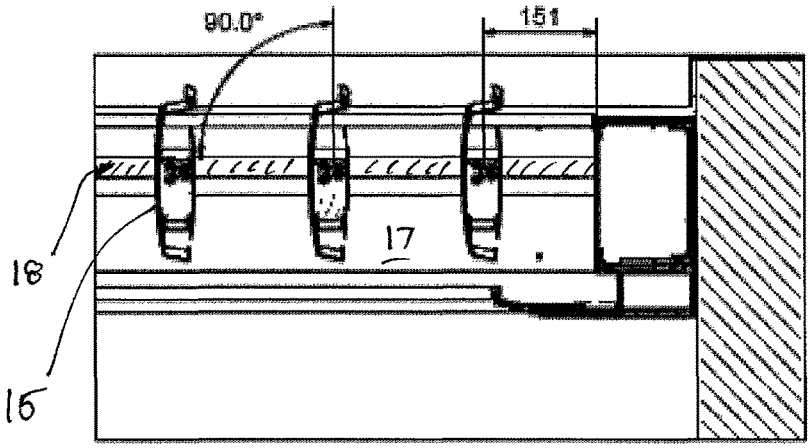
Figure 7C:
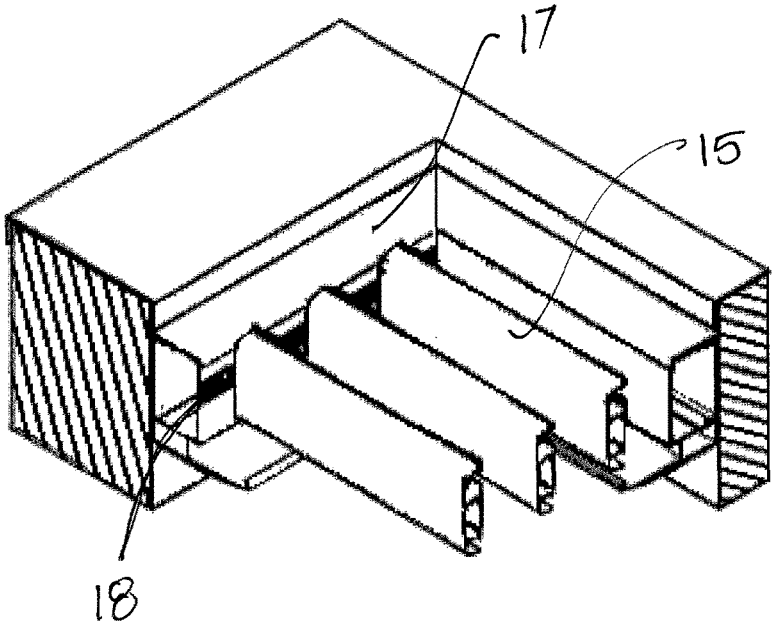

FIGS. 7A-7C depict the roofing structure 10 in yet another state, whereby the louvres 15 are extended to span the recess in the roof, but are rotated to extend vertically as shown. This state provides a more open roof structure 10 that enables more light and air to pass through the roofing structure 10 to provide a more outdoor feel to the underlying space. Once again, the angular movement of each louvre 15 is provided by controlling the gearboxes housed within the boxes 17 located at each side 16*b*, 16*c* of the structure and which are provided at each end of each louvre 15. As the louvres 15 are mounted to a mounting arm of each gearbox that extends out each slot 18, each louvre 15 is able to be rotated from each end thereof, sharing the load between each end.

Figure 8A:
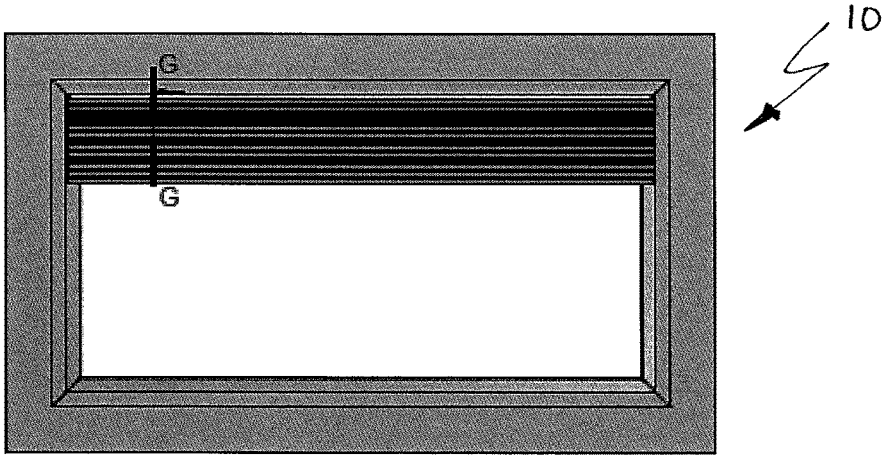
FIG. 8A-8C are top, cross-sectional and perspective views of a portion of the roof structure of FIG. 4 with the louvres in a retracted position.
Figure 8B:
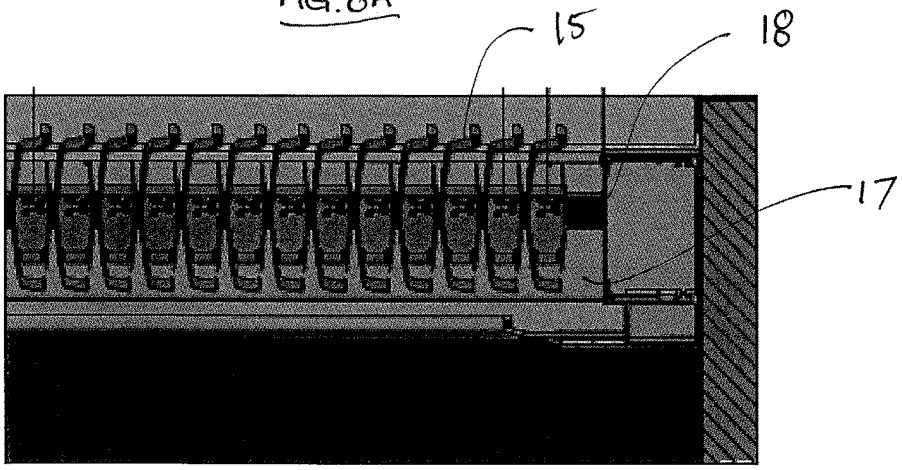
Figure 8C:
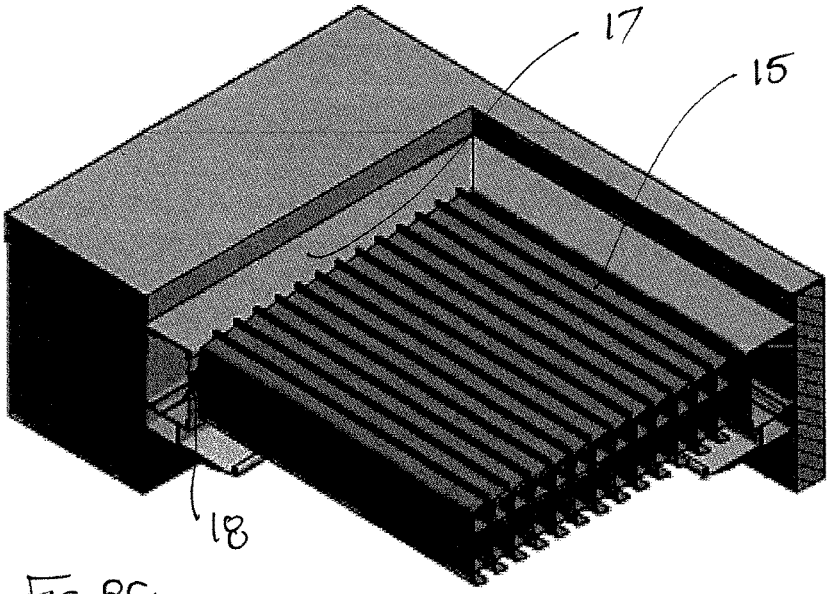

FIGS. 8A-8C depict the roofing structure 10 in yet another state, whereby the louvres 15 are fully retracted against the rear side 16*a* of the structure. This is shown in FIG. 8A. To achieve this state, each of the louvres 15 are firstly rotated to extend vertically with respect to the roofing structure 10 and the retraction system mounted within the boxes 17 on either side 16*a*, 16*c* of the structure is activated to retract the louvres towards the rear of the structure 10. It will be appreciated that the system may be configured to retract the louvres 15 to the front of the structure if desired and in some instances, the system may be configured to retract half of the louvres to the front of the structure and the other half of the louvres to the rear of the structure as required. The manner in which this is achieved will be discussed in more detail below.

Figure 9:
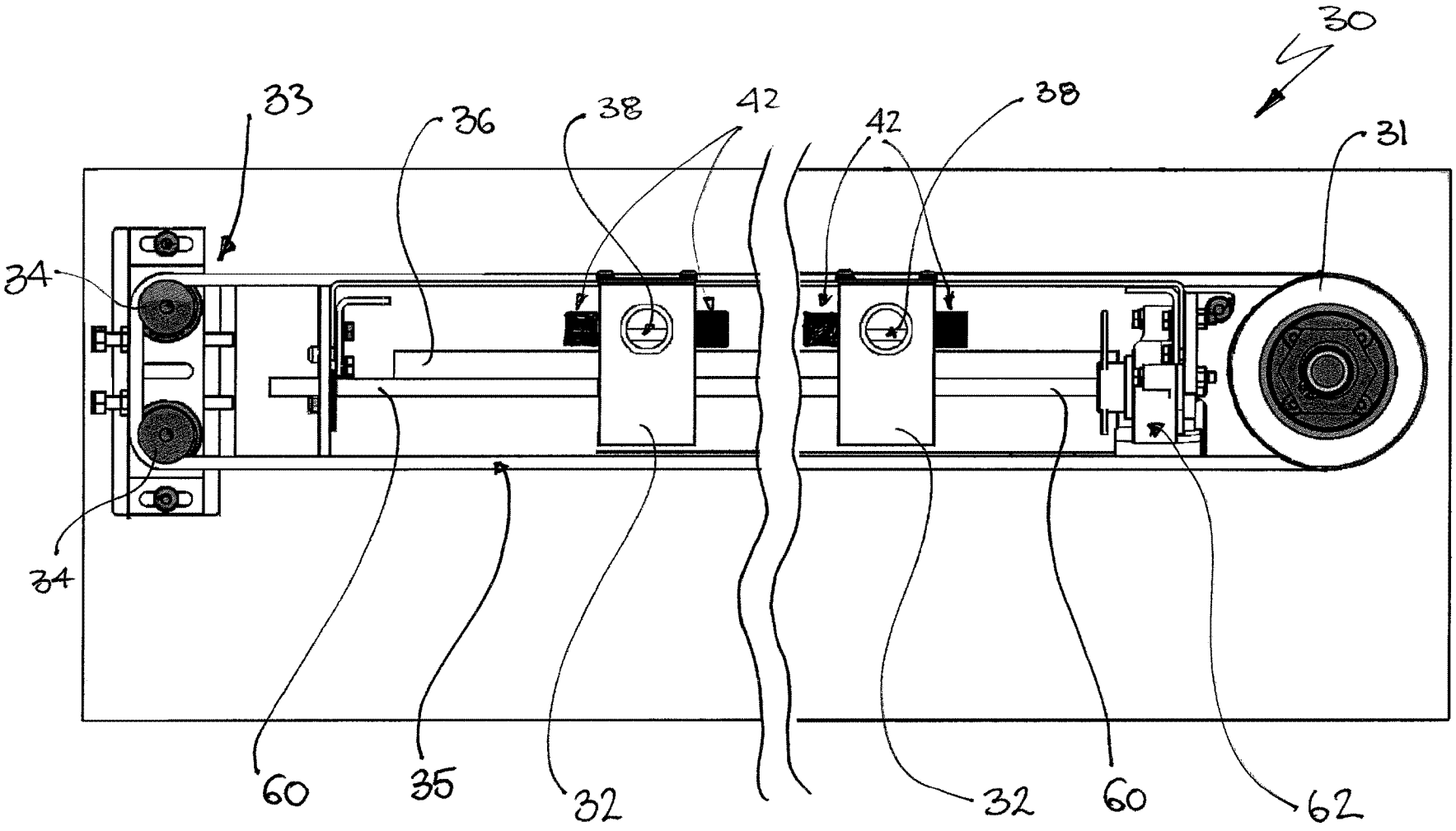
FIG. 9 is a shortened cross sectional side view depicting the retraction system in accordance with the present invention.
Figure 10:
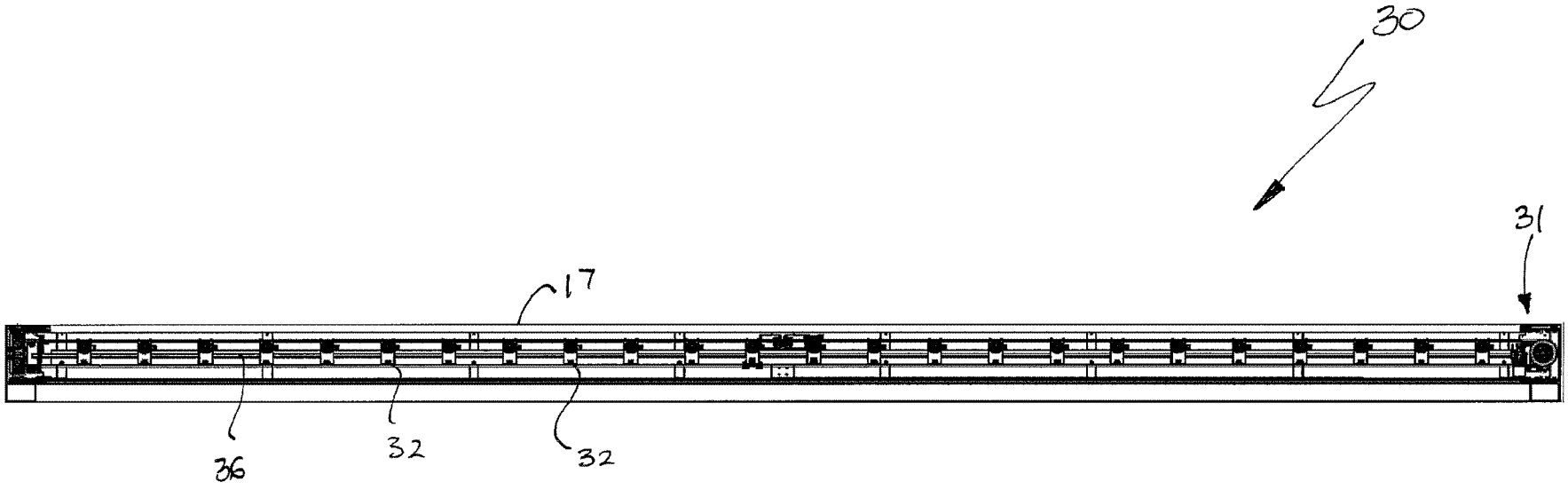
FIG. 10 is a lengthened cross-sectional side view depicting the retraction system of FIG. 9.

Referring to FIGS. 9 and 10, the louvre retraction system 30 of the present invention is depicted. As is shown more clearly in FIG. 10, the retraction system 30 is configured to be housed within box 17 and comprises a drive pulley 31 mounted at one end and an adjustable pulley assembly 33 at the other end. The adjustable pulley assembly 33 comprises an upper and lower pulley wheel 34 around which a drive belt 35 passes. The drive belt 35 extends the length of the box 17 and is in operational engagement with the drive pulley 31 in the manner as best depicted by FIG. 9. The adjustable pulley assembly 33 is able to be laterally adjustable in position to facilitate fitting of the drive belt 35 and to ensure that any slack present in the drive belt 35 is removed.

Figure 11:
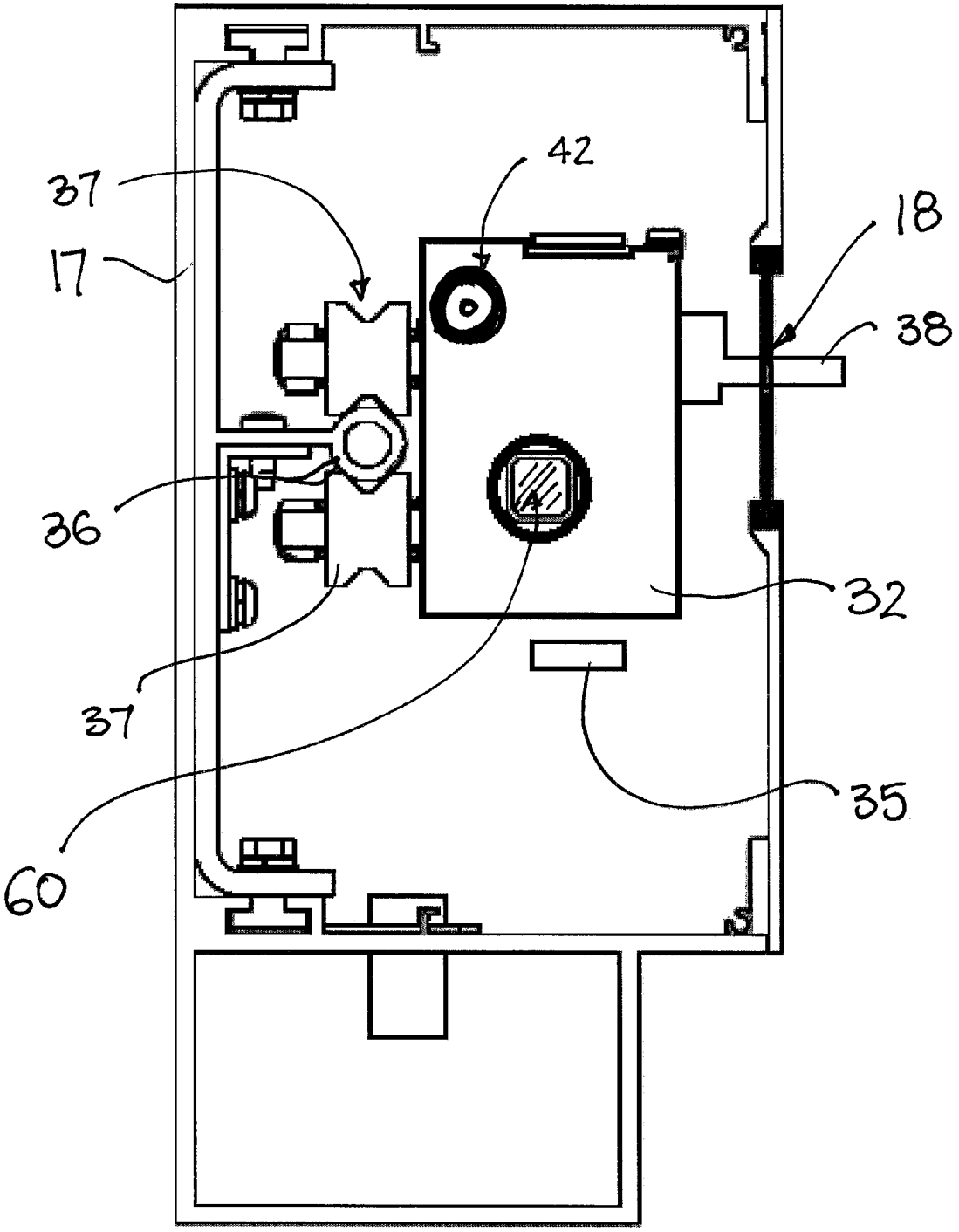
FIG. 11, is an end view of the retraction system of FIGS. 9 and 10.
Figure 13:
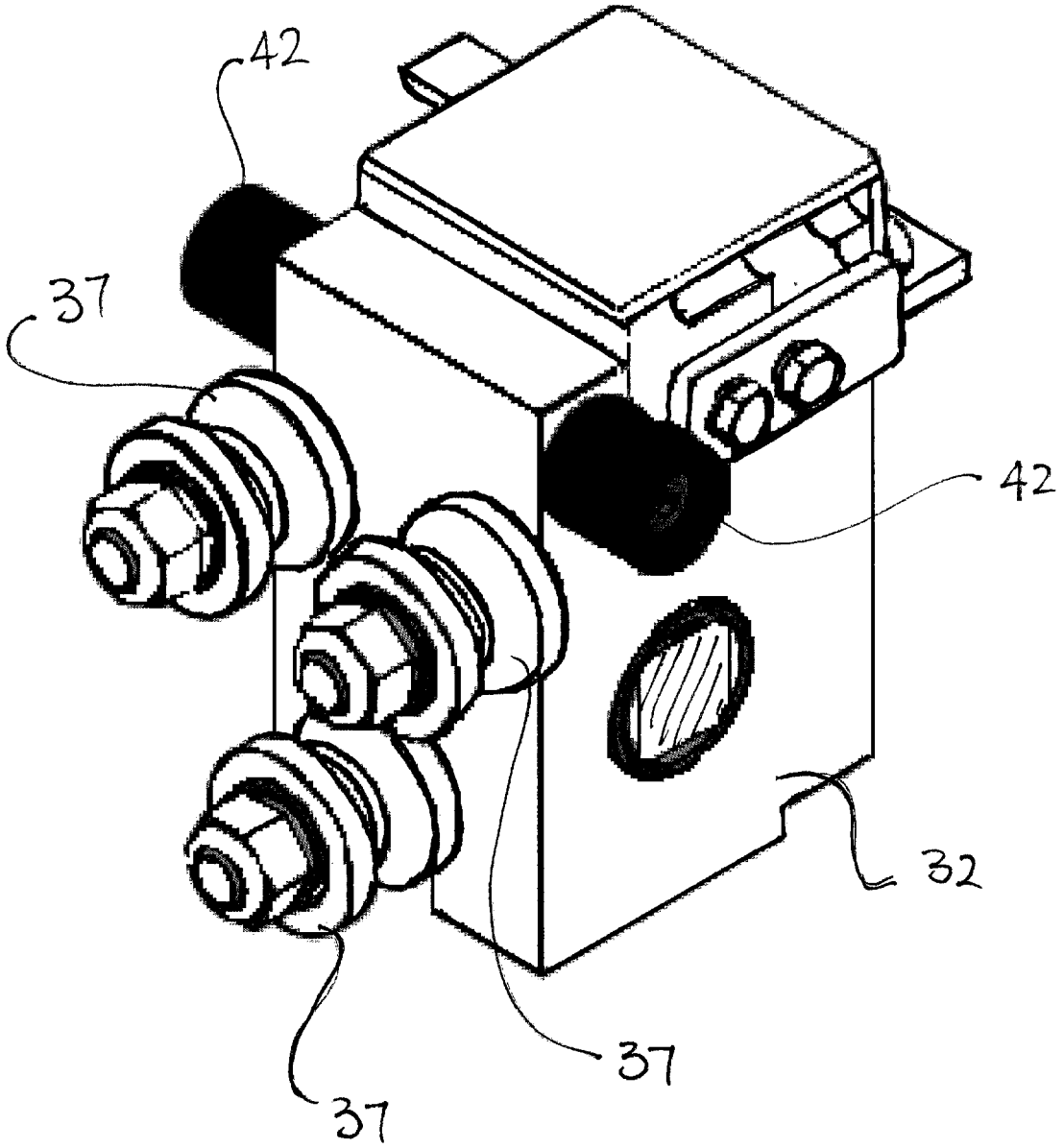
FIG. 13 is an isolated perspective view of the gearbox member of FIG. 11.

A track member 36, in the form of a circular tube, extends substantially the length of the box 17. A plurality of gearboxes 32 are mounted to travel along the track member 36 in the manner as shown in FIG. 11. In this regard, each gearbox 32 has a three V-wheels 37, namely a pair of upper V-wheels 37 mounted to a rear surface thereof and a vertically displaced lower V-wheel 37, as is more clearly shown in FIG. 13. The V-wheels 37 are made from a plastic or similar material and are fitted about the track member so as to clamp about the track member 36 from an upper and lower position, as best depicted in FIG. 11. As a result of this, each gearbox 32 is able to travel laterally along the track member 36 in a forward and rearward direction depending upon whether the louvres are to be in an extended or retracted position. The manner in which the gearboxes 32 are driven will be described in more detail below.

It will be appreciated that for each length of louvre, the angle of orientation of the associated gearbox may change. If there is a degree of misalignment between the gearboxes 32 and the louvre, this can cause forces to build up within the gearbox 32 which can cause premature wear and failure of the gearboxes. However, as the V-wheels 37 engage about the track member 36 in a manner which allows a degree of rotation of the gearboxes 32 with respect to the track member 36, the gearboxes 32 can rotate to match the angle of the louvre which is governed by the angle of the length and fall of the louvre, thus minimising unwanted forces building up within the gearbox and maximising gearbox life.

Further to this, as the track member 36 is mounted within the structure, over time it will be exposed to dust and dirt collecting along the surface thereof. Due to the action of the V-Wheels 37 travelling along the track member 36 and being able to rotate in relation thereto, the V-wheels 37 are able to act as a self-cleaning mechanism that continually cleans the tracks and does not allow dirt and dust to build up, as is a common problem with most existing C-channel tracks employed for similar purposes.

The provision of three V-wheels 27 to engage with the track member 36, namely with two V-wheels located on the top and one V-wheel located underneath, enables the system to be simply adjusted to ensure that the engagement of the V-wheels with the track is snug. This can then prevent rotation of the gearboxes 32 and prevent any upward or downward movement of the louvres due to wing loading events and the like.

As mentioned previously, each gearbox 32 is a low friction gearbox and is mounted to an end of a louvre 25 by way of the mounting member 38 that extends from a slot 18 in the box 17. This is shown in FIG. 11 with the mounting member 38 being in the form of a flat pin member. It will be appreciated that the flat pin member 38 will engage with an end of the louvre 25 and each gearbox 32 is able to be controlled to rotate the mounting member 38, thereby causing the louvre to rotate in the same direction. This is achieved by an actuation carriage 60 being configured to extend through each gearbox 32 so as to operatively engage with the mounting member 38. The actuation carriage 60 is mounted at one end to an actuator 62 which is controlled to impart rotation to the actuation carriage 60 so as to control the state of the louvres 25. As is shown more clearly in FIG. 9, the actuator 62 is mounted towards one end of the box 17. In the embodiment as shown, the actuation carriage 60 is substantially square in cross section and is received within a square recess extending through each gearbox 32. Upon rotation of the actuation carriage 60, the rotation is transferred to the mounting member 38 of each gearbox thereby causing the associated louvres 25 to rotate in unison with each other. It will be appreciated that such gearboxes are well known in the art and will not be described in further detail.

It will be appreciated that, as each gearbox 32 is a low friction gearbox, it requires very low torque to rotate each of the louvres 25 as provided by the actuation carriage 60. This allows the electrical control system of the actuator 62 to detect an amperage increase during opening/closing the louvres which is indicative of the presence of an obstacle between the louvres, such as a person's fingers or a body part, preventing louvre movement. Through being able to detect such changes in amperage, the present system is able to cut/off the actuator 62 as a safety mechanism should the amperage reach a present level. It will be appreciated that if the gearbox friction is too high, a larger motor is required in the actuator 62 to rotate the multiple louvres. As such, the sensitivity of the system is significantly reduced and detection of changes in amperage within the control system is no longer possible with any precision. Thus, the present invention is configured to enable such detection due to the configuration of the gearboxes and the manner in which they are actuated. The low friction gearboxes 32 also enable a much smaller motor to be used in the actuator 62 to rotate the louvres.

Figure 12:
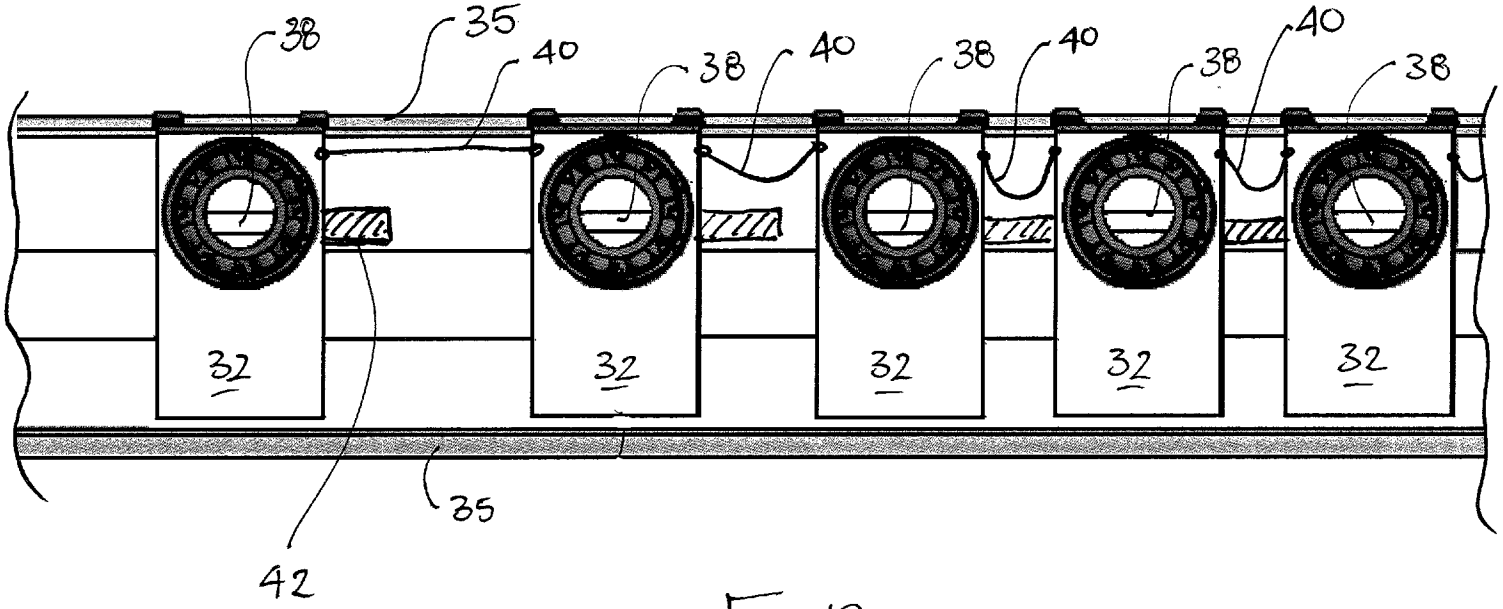
FIG. 12 depicts the manner in which the retraction system of the present invention is coordinated to move the louvres.

The manner in which the gearboxes 32 are able to be extended and retracted is depicted in FIG. 12. As is shown, the leading gearbox 32 is attached to the drive belt 35 at the upper or lower end thereof, such that movement of the drive belt 35 under action of the drive pulley 31 will cause the leading gearbox 32 to move along the track member 36. Each gearbox along the line is connected by way of a timing belt 40 with the pitch of the timing belt extending between adjacent gearboxes 32 being the same. The use of such a timing belt 40 ensures that during the extension and retraction process, the timing belt 40 is bent in a consistent manner each time. Unlike using wire, string or rope to form this function, the presence of teeth within the timing belt 40 ensures that the belt 40 always folds in the same direction to enable control over how the belt folds during the stacking process, which is repeatable time after time. If wire, string or rope is used, such materials fold or bend in an unpredictable manner and are prone to tangling, thus increasing the likelihood of the system becoming jammed or otherwise malfunctioning, and requiring costly intervention and ongoing servicing.

When retracted, there is a degree of slack in the timing belt 40 between adjacent gearboxes 32, as shown in FIG. 12. Once the leading gearbox 32 moves under action of the driving belt 35 such that the slack is removed between that gearbox 32 and the trailing gearbox 32, the trailing gearbox will then be caused to moving along the track member 36 under a towing action. This process will continue until each of the gearboxes 32 are advanced along the length of the box 17, with the spacing between the gearboxes being retained at the same distance as dictated by the length of the timing belt 40.

In order to retract the louvres 25, the drive pulley 31 is merely reversed such that the leading gearbox 32 is caused to move back towards the drive pulley 31. As each of the gearboxes 32 have a stopper 42 that projects from a trailing end thereof, as the leading gearbox 32 is brought towards the trailing gearbox, the timing belt 40 slackens until the stopper 42 contacts the leading face of the trailing gearbox thereby pushing that gearbox 42 back towards the drive pulley 31. This creates a concertina effect thereby retracting the louvres and pushing the louvres 25 towards one end of the roofing structure. It will be appreciated that prior to retraction of the louvres, the gearboxes will cause the louvres to rotate into a vertical position to ensure maximum retraction.

As the gearboxes 32 travel along the track member 36 by way of the V-wheels 37, this arrangement enables a degree of swivel movement of the gearbox 32 with respect to the track member 36. In this regard, as the gearboxes adjust the orientation of the louvres, for different lengths of louvres the angular orientation of the gearbox will change. As the V-wheels 37 clamp about the track member 36, there is a wide scope of angular adjustment available to accommodate different angles of the louvres, which is also assisted due to the round nature of the track member 36. Such a means for moving the gearboxes also enables a degree of self-cleaning of the track member 36 due to the swivel nature cleaning the track surfaces.

It will be appreciated that each gearbox 32 is connected to an end of a louvre 25 with the other end of the louvre 25 being connected to an idler carriage of an identical retraction system. The idler carriage also contains a timing belt 40 to set the pitch between idler carriages. The idler carriage also functions to accommodate any misalignment between the two carriages as the shaft of the idler carriage slides in and out of a simple housing. It will be appreciated that, in such an arrangement, both drive pulleys can be controlled in unison to provide a controlled louvre retraction and extension arrangement, with minimal likelihood of jamming of the louvres due to misalignment. To accommodate small misalignments between the opposing tracks, the idler carriage has a free floating shaft that connects to the louvre.

Similarly, as the spacings between the louvres when extended are set by the timing chain, the louvres can be simply and effectively moved in to an abutting manner that provides a sealed and enclosed roofing structure. The ability to control both ends of the louvre movement in such a finite manner ensures that the louvres are continually moved in a controlled manner to minimise misalignment of louvres and potential leakages in the roof structure.

Through-out the specification and claims the word "comprise" and its derivatives is intended to have an inclusive rather than exclusive meaning unless the context requires otherwise.

Orientational terms used in the specification and claims such as vertical, horizontal, top, bottom, upper and lower are to be interpreted as relational and are based on the premise that the component, item, article, apparatus, device or instrument will usually be considered in a particular orientation, typically with the assembly uppermost.

It will be appreciated by those skilled in the art that many modifications and variations may be made to the methods of the invention described herein without departing from the spirit and scope of the invention.

The invention claimed is:

1. An architectural structure, comprising:

a frame having a rear end, a front end and a pair of side walls connecting the front end and the rear end; and a plurality of louvres extending substantially between the side walls, at least one end of the louvres being mounted to a gearbox member for controlling angular orientation of the louvre, each said gearbox member is mounted upon a track extending substantially along a length of at least one side wall and at least one of the gearbox members is mounted to a belt driven by a drive pulley for facilitating longitudinal movement of said at least one gearbox member along said track and rotational movement of said at least one gearbox member about a longitudinal axis of the track, said track being substantially circular in cross-section and each said gearbox member is mounted to the track via at least two opposing V-wheels which engage the track;

wherein, each said gearbox member is attached to an adjacent gearbox member via a connector, whereby a length of the connector extending between the adjacent gearbox members is constant such that when the louvres are in an extended position, spacing between the louvres is maintained at a predetermined distance.

2. An architectural structure according to claim 1, wherein the connector is a belt and the pitch of the belt extending between the adjacent gearboxes is controlled to maintain the spacing between louvres when in the extended position at a predetermined distance.

3. An architectural structure according to claim 1, wherein said at least two opposing V-wheels comprise three V-wheels with two said V-wheels of said three V-wheels being laterally disposed to engage with an upper surface of the track and one said V-wheel of said three V-wheels engaging with a lower surface of the track.

4. An architectural structure according to claim 1, wherein each of the louvres are mounted at one end to the gearbox member that is controllable to vary the angular orientation of the louvre, and each of the louvres are mounted to an opposing end of an idler gearbox that supports the louver and facilitates angular movement of the louvre under action of the gearbox member.

* * * * *